US010465999B2

(12) United States Patent
Thomele et al.

(10) Patent No.: US 10,465,999 B2
(45) Date of Patent: Nov. 5, 2019

(54) HANDGUN WITH FORWARD ASSIST

(71) Applicant: Sig Sauer, Inc., Newington, NH (US)

(72) Inventors: Adrian Thomele, Stratham, NH (US); Tyler Rainaud, Newington, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 16/229,656

(22) Filed: Dec. 21, 2018

(65) Prior Publication Data

US 2019/0195582 A1 Jun. 27, 2019

Related U.S. Application Data

(60) Provisional application No. 62/609,975, filed on Dec. 22, 2017.

(51) Int. Cl.

| | |
|---|---|
| ***F41A 3/78*** | (2006.01) |
| ***F41A 3/84*** | (2006.01) |
| ***F41A 3/72*** | (2006.01) |
| ***F41A 9/38*** | (2006.01) |

(52) U.S. Cl.

CPC ..... *F41A 3/84* (2013.01); *F41A 3/72* (2013.01); *F41A 9/38* (2013.01); *F41A 3/78* (2013.01)

(58) Field of Classification Search

CPC ..... F41A 3/72
USPC ..... 89/178, 194–196, 198, 1.4
See application file for complete search history.

(56) References Cited

U.S. PATENT DOCUMENTS 4,593,601 A * 6/1986 Smith ..... F41A 3/82 89/196
6,234,059 B1 5/2001 Fuchs et al.
6,401,379 B1 6/2002 Moon
6,993,864 B1 2/2006 O'Clair et al.
D598,065 S 8/2009 Vukovic et al.
D654,978 S 2/2012 Karanian et al.
8,316,754 B2 * 11/2012 Gugliada ..... F41A 3/78 42/1.06
D681,131 S 4/2013 Su
8,448,364 B2 5/2013 Davidson
D690,374 S 9/2013 Lee
D692,513 S 10/2013 Yigit
9,021,730 B2 5/2015 Gentilini et al.
D744,049 S 11/2015 Chu
9,194,654 B1 * 11/2015 Viani ..... F41A 3/72
D754,802 S 4/2016 Martelli et al.
9,303,936 B2 4/2016 Toner
(Continued)

OTHER PUBLICATIONS

"Instruction Manual for Ruger American Pistol Pro Model", Sturm, Ruger & Co., Inc. (2016). 43 pages.
(Continued)

*Primary Examiner* — Reginald S Tillman, Jr.
(74) *Attorney, Agent, or Firm* — Finch & Maloney PLLC

(57) ABSTRACT

A handgun subassembly includes a frame with a distal frame portion and a proximal frame end portion, where the frame has frame rails extending longitudinally along a top of the frame. A slide is displaceable along the frame rails between a recoil position and a battery position. The slide defines a catch surface adjacent a bottom portion of the slide. A forward assist assembly is disposed between the slide and the frame or grip module. The forward assist assembly provides a force on the slide in a distal direction when the slide is within a predetermined distance from the battery position.

23 Claims, 8 Drawing Sheets

(56) References Cited

U.S. PATENT DOCUMENTS

| | | | |
|---|---|---|---|
| 9,310,160 | B1 | 4/2016 | Dichario |
| D755,324 | S | 5/2016 | Martelli et al. |
| D755,907 | S | 5/2016 | Hu |
| D758,519 | S | 6/2016 | Toner et al. |
| 9,441,897 | B2 | 9/2016 | Mather et al. |
| 9,546,831 | B2 | 1/2017 | Bandini et al. |
| 9,551,550 | B2 | 1/2017 | Wells |
| 9,664,471 | B1 | 5/2017 | Curry et al. |
| D791,262 | S | 7/2017 | Brown et al. |
| D803,341 | S | 11/2017 | Wolfe |
| D808,487 | S | 1/2018 | Beville et al. |
| D814,593 | S | 4/2018 | O'Clair et al. |
| D814,596 | S | 4/2018 | Curry |
| D815,233 | S | 4/2018 | Toner et al. |
| D823,969 | S | 7/2018 | Beville et al. |
| D828,881 | S | 9/2018 | Lee |
| D828,892 | S | 9/2018 | Kellgren |
| D830,480 | S | 10/2018 | Chu |
| 10,088,269 | B2 | 10/2018 | Sheets, Jr. et al. |
| D834,656 | S | 11/2018 | Chu |
| 2001/0037596 | A1 | 11/2001 | Salvitti |
| 2019/0154368 | A1 | 5/2019 | Kim et al. |

OTHER PUBLICATIONS

"Instruction Manual for Ruger American Pistol, Standard Model", Sturm, Ruger & Co., Inc. (2016). 44 pages.
Ruger American Pistol Pro Model Parts List, pp. 34-37 (2016).

* cited by examiner

HANDGUN WITH FORWARD ASSIST

RELATED APPLICATIONS

This application claims priority under 35 U.S.C. § 119(e) to U.S. Provisional Patent Application No. 62/609,975 titled HANDGUN WITH FORWARD ASSIST and filed on Dec. 22, 2017, the contents of which are incorporated herein by reference in its entirety.

FIELD OF THE DISCLOSURE

This disclosure relates to firearm assemblies and more particularly to a semiautomatic handgun with a structure to assist moving the slide to battery.

BACKGROUND

Development of the semiautomatic handgun began in the early 1890s following the invention of "smokeless" gun powder. Gun manufacturers in the United States, Austria, Germany, Spain, and other countries explored various designs for auto-loading pistols, including the Salvator Dormus Laumann model 1892, the Mauser model 1896, the Fabrique Nationale model 1899, and the Luger model 1899/1900. One semiautomatic handgun enduring for more than one hundred years is the model M-1911 designed by John Browning and originally produced by Colt. The M-1911 uses a short recoil operating principle that forms the basis for nearly all modern centerfire pistols. Features of modern semiautomatic pistols include a grip module with a handgrip portion that houses a detachable box magazine. A slide is displaceable along the top of the grip module. The action can be cycled using a blowback, delayed blowback, or blocked breech system, depending on the caliber of the handgun. In any case, discharging the handgun causes the slide to move rearward against spring forces and eject the spent shell casing, followed by the slide returning forward while chambering another round. With the slide in battery, the handgun is cocked, the chamber is locked, and the handgun is ready to fire.

Traditionally, semiautomatic handguns have included a metal frame to which additional components are attached, such as the fire control group, barrel, slide, safety levers, grip panels, and other parts of the handgun. Some metal-framed semiautomatic handguns include a hammer and firing pin with double action, single action, or a combination of double and single action. More recently, handguns have been introduced that have a polymer grip module with a hand grip, trigger guard, and distal portion that extends along the barrel and slide. A separate metal frame is installed into a well that is defined between opposite sidewalls the grip module and includes components of the fire control group. Some such handguns are striker-fired, where the action includes a striker held in spring tension until released forward to impact the ammunition primer by pulling the trigger.

SUMMARY

The present disclosure is directed to a semiautomatic handgun or handgun subassembly with a forward assist configured to advance the slide to full battery. The forward assist applies an additional force to that provided by the recoil return spring to assist in moving the slide fully to battery, in accordance with some embodiments. For example, the forward assist can be an actuator (e.g., spring, piston, etc.) disposed between the slide and the frame or grip module of the handgun.

Figure 1:
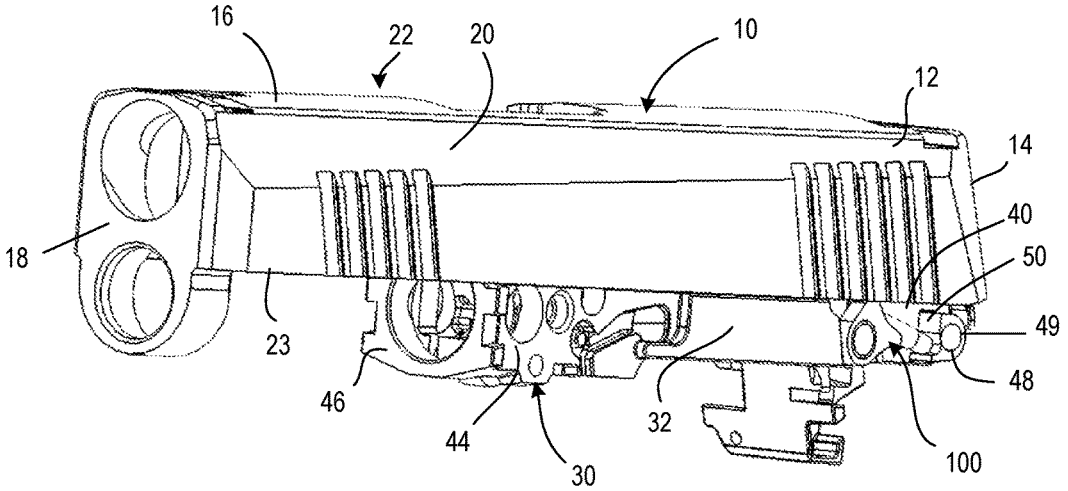
FIG. 1 illustrates a front and left-side perspective view of a handgun slide, frame, and forward assist assembly, in accordance with an embodiment of the present disclosure.

These and other features of the present embodiments will be better understood by reading the following detailed description, taken together with the Figures herein described. For purposes of clarity, not every component may be labeled in every drawing. Furthermore, as will be appreciated, the Figures are not necessarily drawn to scale or intended to limit the present disclosure to the specific configurations shown. In short, the Figures are provided merely to show example structures.

DETAILED DESCRIPTION

The semiautomatic handgun is an auto-loading firearm with a slide that is displaceable along the frame of the handgun. One position of the slide is a forward or battery position, where the chamber is closed and the handgun is ready to fire. In response to firing, or when the user cycles the action manually, the slide moves rearward along slide rails to a rearward position or recoil position with the chamber open. One particular recoil position is the slidelock position, in which the slide is retained in an open position by a slidelock lever that engages the slide. From the recoil position or slidelock position, the slide can move or be released forward to battery while at the same time chambering a round of ammunition and closing the chamber in preparation to fire.

In some instances, however, the slide fails to move fully forward to battery, leaving the handgun in a state of malfunction and unable to fire. For example, the slide moves forward almost all the way to battery except for a few millimeters of final movement needed to close the chamber. In addition to not firing, the malfunction can be detected by seeing the proximal end of the slide misaligned axially with the proximal end of the grip module or frame, usually, for example, about 2-3 mm. This failure, sometimes referred to an out-of-battery malfunction, can result from many causes. In some instances, the out-of-battery malfunction can occur after moving the slide slightly rearward for a "press check" so the user can peek into the chamber to determine if a round is present. After performing the press check, the slide may not return fully to battery. When the out-of-battery malfunction is due to performing a press check, the malfunction can be cured by hitting the back of the slide with the hand to push the slide fully to battery. In other instances, the out-of-battery malfunction can result from riding the slide with the hand during a reload sequence instead of allowing the recoil return spring to return the slide forward. In yet other instances, a dirty handgun, and/or a worn recoil return spring can result in an out-of-battery malfunction. Depending on the cause, these causes of the malfunction can be remedied by improved user technique, performing a tap-rack sequence, or replacing the recoil return spring.

Some handguns have a weaker recoil return spring by design to make cycling the action easier for the user. Also, handguns chambered for small calibers, such as .22 LR, .380 Auto, and the like are generally equipped with a weaker recoil return spring than their 9 mm, .40, and .45 caliber counterparts. The weaker recoil return spring is sufficient to cycle small-caliber handguns and makes the slide easier to rack. However, if the user does not grip the handgun firmly, places a finger on the slide while gripping the handgun, points the handgun upwards when cycling the action, or performs some other act that impedes the function of the recoil return spring, the slide in small-caliber handguns may not return to full battery. While the tap-rack sequence may clear this malfunction, the handgun's reliability comes into question if the malfunction occurs repeatedly. A stronger recoil return spring can also be used to remedy the malfunction, but this option is not optimal since the stronger spring may be excessive for the ammunition and makes the slide more difficult to rack.

One aspect of the present disclosure addresses the out-of-battery malfunction in semiautomatic handguns by providing a forward assist assembly configured to augment the force of the recoil return spring to move the slide fully to battery. In some embodiments, the forward assist assembly adds a distal force to the slide only when the slide is within a predetermined distance from the battery position. The additional force provided by the forward assist assembly facilitates moving the slide fully to battery.

General Overview

In one aspect of the present disclosure, a handgun subassembly includes a frame with a distal frame portion and a proximal frame end portion, where the frame has frame rails extending longitudinally along a top of the frame. A slide is displaceable along the frame rails between a recoil position and a battery position. The slide defines slide channels corresponding to the frame rails and extending along the slide from a distal slide portion to a proximal slide end. The slide defines a catch surface adjacent a bottom portion of the slide. A forward assist assembly is disposed between the slide and the proximal frame end portion, where the forward assist assembly provides a force on the slide in a distal direction when the slide is within a predetermined distance from the battery position. For example, the forward assist assembly includes a lever rotatably attached to the frame and an actuator disposed between the lever and the frame. The lever can engage the catch surface to apply a distal force to the slide. The actuator can be, for example, a coil spring, a torsion spring, a helical spring, a spring piston, or other suitable actuator. In one embodiment, the lever includes a first working arm and a second working arm, where the first working arm engages the catch surface to apply a force to the slide in a distal direction when the slide is within the predetermined distance from the battery position. For example, in a pre-battery position when the slide is within about 5 mm from battery, the first working arm engages the catch surface and applies a force to move the slide distally to the battery position.

As discussed herein, terms referencing direction, such as upward, downward, vertical, horizontal, left, right, front, back, etc., are used for convenience to describe embodiments of the present disclosure relative to a handgun in a traditional shooting position with the barrel oriented horizontally and the grip extending downward from the frame. Embodiments according to the present disclosure are not limited by these directional references and it is contemplated that a handgun and its components discussed herein could be used in any orientation.

As will be appreciated in light of this disclosure, and in accordance with some embodiments, features of the forward assist assembly can be used with striker-fired and hammer-fired handguns alike, including handguns with a polymer grip module. In accordance with some example embodiments, a forward assist assembly is provided as part of a semiautomatic handgun chambered in .22 LR, .380 Auto, 9 mm Luger, .357 SIG, 10 mm Auto, .40 S&W, .45 ACP, or other suitable pistol ammunition. Other suitable host firearms and chamberings will be apparent in light of this disclosure.

In accordance with some embodiments, the disclosed apparatus may be detected, for example, by visual inspection of a handgun or handgun subassembly having features such as a forward assist assembly disposed between the slide and the frame or grip module, where the forward assist assembly biases the slide towards battery position. Also, it should be noted that, while generally referred to herein as a forward assist assembly or forward assist for consistency and ease of understanding the present disclosure, the disclosed forward assist assembly is not limited to that specific terminology and alternatively can be referred to, for example, a forward bias, a slide push mechanism, a slide bias, an auxiliary recoil spring, or other terms. As will be further appreciated, the particular configuration (e.g., materials, dimensions, etc.) of a forward assist assembly configured as described herein may be varied, for example, depending on whether the intended use is military, tactical, sport, or civilian in nature. Numerous configurations will be apparent in light of this disclosure.

Structure and Operation

Figure 2:
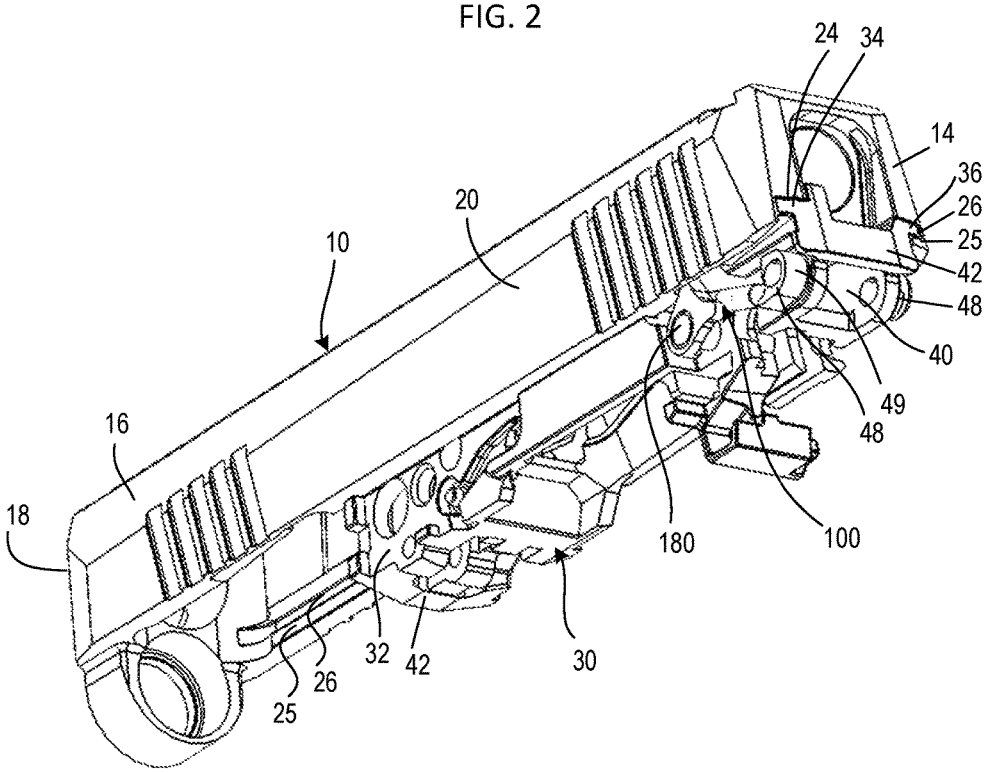
FIG. 2 illustrates a bottom, rear, and left-side perspective of the slide, frame, and forward assist assembly of FIG. 1, in accordance with an embodiment of the present disclosure.
Figure 3:
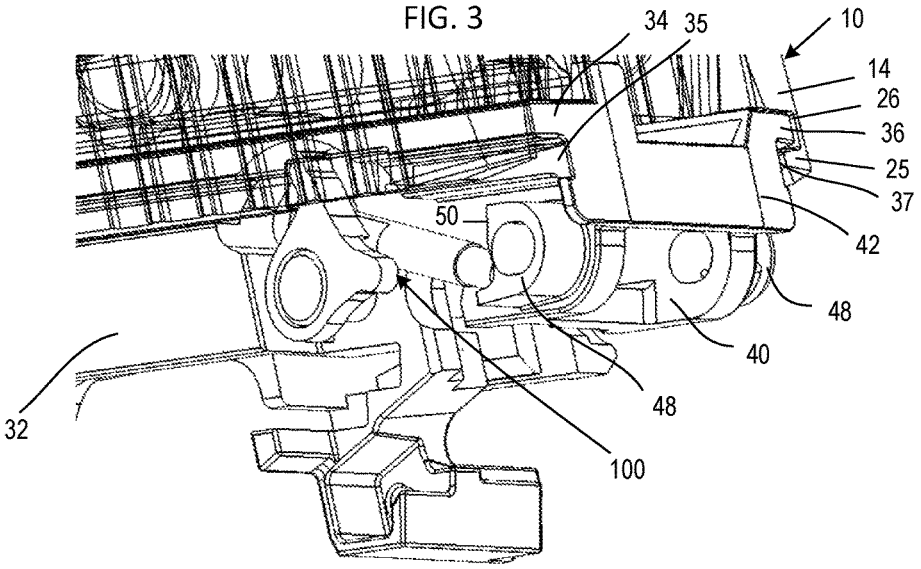
FIG. 3 illustrates a close-up rear and left-side perspective view showing a portion of the forward assist assembly of FIG. 1, in accordance with an embodiment of the present disclosure.

Referring now to FIGS. 1-3, a slide 10, a frame 30, and a forward assist assembly 100 of a semiautomatic handgun are illustrated in accordance with an embodiment of the present disclosure. FIG. 1 illustrates a front and left-side perspective view of slide 10, frame 30, and forward assist assembly 100; FIG. 2 illustrates a bottom, rear, and left-side perspective view of slide 10, frame 30, and forward assist assembly 100; and FIG. 3 illustrates a rear and left-side perspective close-up view of forward assist assembly 100 and portions of slide 10 and frame 30.

Slide 10 extends longitudinally with opposed, spaced-apart sidewalls 20, 22 from a proximal slide portion 12 with proximal slide end 14 to a distal slide portion 16 with distal slide end 18. Sidewall 20 defines a slide channel 24 and slide rail 23; sidewall 22 defines a side rail 25 and slide channel 26, where side rails 23, 35 and slide channels 24, 26 extend longitudinally along slide 10 from proximal slide end 14 to distal slide end portion 16. Slide channels 24, 26 correspond to and are constructed to receive frame rails 34, 36 on frame 30, respectively; slide rails 23, 25 correspond to and are constructed to be received in frame channels 35, 37, respectively. Accordingly, mating slide channels 24, 26 with frame rails 34, 36 and mating slide rails 23, 25 with frame channels 35, 37 enables slide 10 to be displaced in a reciprocating movement along frame 30 and to be slidingly removed from frame 30.

Figure 4:
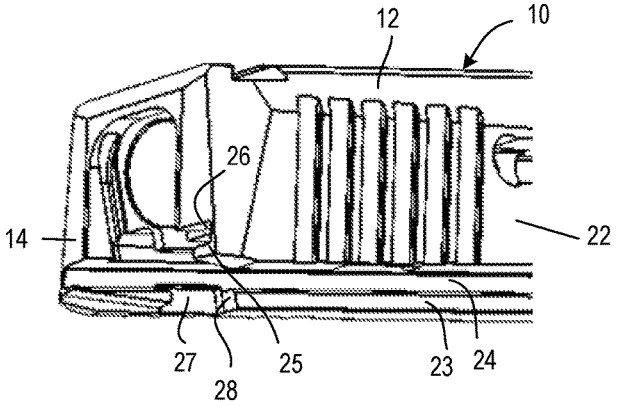
FIG. 4 illustrates a rear and right-side perspective view of a slide showing a notch in the slide rail that defines a catch surface, in accordance with an embodiment the present disclosure.

FIG. 4 illustrates a rear and right-side perspective view of proximal slide end portion 12 in accordance with an embodiment of the present disclosure. Slide rail 23 has a recess 27 defining a catch surface 28 configured to engage part of forward assist assembly 100. For example, recess 27 is a rectangular notch, an opening, or other feature in or on slide 10 that defines catch surface 28. In one embodiment, recess 27 is a rectangular notch extending through slide rail 23 to slide channel 24, where catch surface 28 is on slide rail 23 adjacent recess 27 and faces proximally. In some embodiments, lever 110 can extend into recess 27 to engage catch surface 28 without obstructing slide channel 24. As shown in FIGS. 1-3 and discussed in more detail below, a lever 110 of forward assist assembly 100 applies a distal force on catch surface 28 to urge slide 10 forward to battery.

Among other positions, slide 10 is displaceable between a full recoil position or slidelock position and a battery position. Slide 10 can also be removed from frame 30 by sliding it distally off frame rails 34, 36. In the recoil position, slide 10 is positioned rearward on frame 30 with distal slide portion 16 adjacent distal frame end 46. In the battery position, as shown for example in FIGS. 1-3, proximal slide end 14 is flush with proximal frame end 42 and the handgun chamber is closed and capable of firing.

Figure 5:
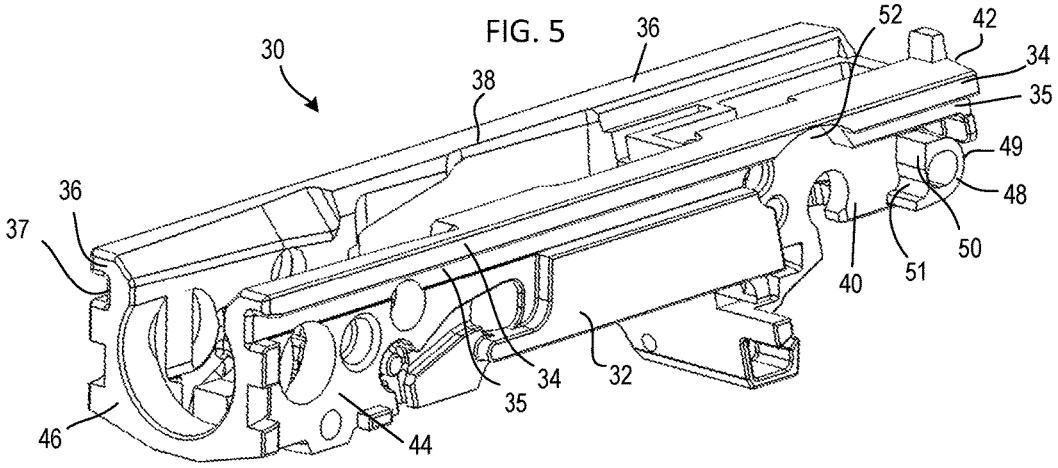
FIG. 5 illustrates a top, front, and left-side perspective view of a frame showing a clearance recess and a lug useful with a forward assist assembly, in accordance with an embodiment the present disclosure.

Referring to the front and left-side perspective view of FIG. 5 and with continued reference to FIGS. 1-3, frame 30 includes a frame chassis 32 with spaced-apart frame rails 34, 36 extending longitudinally along a top frame portion 38, in accordance with an embodiment of the present disclosure. Frame channel 35 is below frame rail 34 and is configured to slidingly receive slide rail 23. Frame channel 37 is below frame rail 36 and is configured to slidingly receive slide rail 25. Chassis 32 has a proximal frame portion 40 with proximal frame end 42 and a distal frame portion 44 with distal frame end 46. In some embodiments, proximal frame end portion 40 includes one or more lugs 48 on chassis 32 that are configured to engage a grip module 250 of the handgun 5 (shown in FIGS. 16-17) when frame 30 is installed therein. For example, each lug 48 is on an outside of frame chassis 23 and has a rounded proximal lug portion 49 corresponding to a lug recess 261 in grip module 250 (shown in FIG. 16). In some embodiments, a distal lug portion 50 defines a recess 51, groove, opening, slot, or the like configured to receive and engage an actuator 150 of forward assist assembly 100.

In some embodiments, frame 30 defines a clearance recess 52 extending laterally into chassis 32. For example, clearance recess 52 has an arcuate shape corresponding to the path of lever 110 as it rotates between various positions of forward assist assembly 100. In some embodiments, clearance recess 52 can extend upward into frame rail 34 and frame recess 35 (or frame rail 36 and frame recess 37) to provide clearance for lever 110 to rotate.

Figure 6:
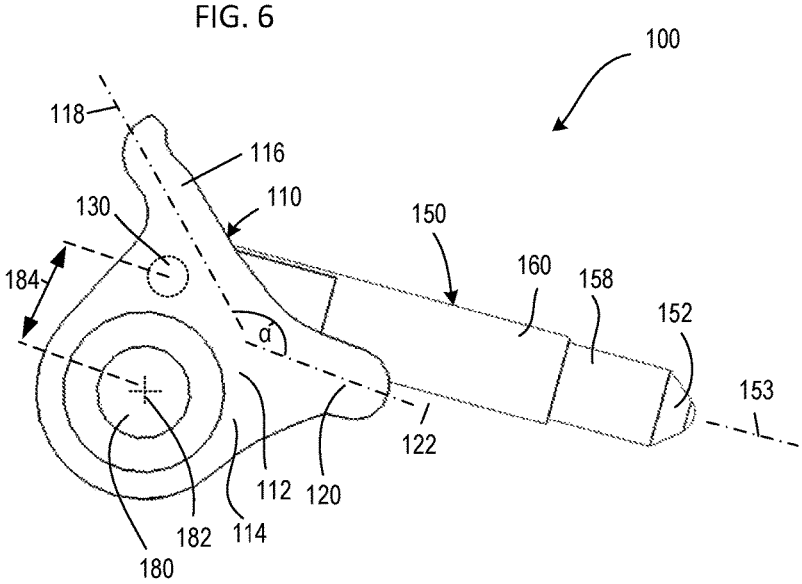
FIG. 6 illustrates a left-side elevational view of a forward assist assembly with a lever and actuator, in accordance with an embodiment the present disclosure.
Figure 7:
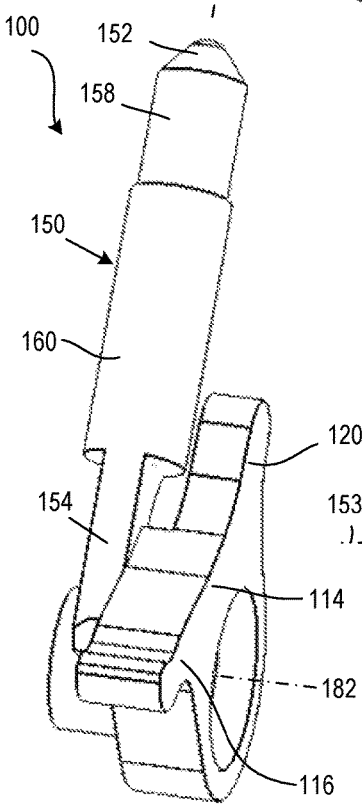
FIG. 7 illustrates a top and right-side perspective view of the forward assist assembly of FIG. 6.
Figure 8:
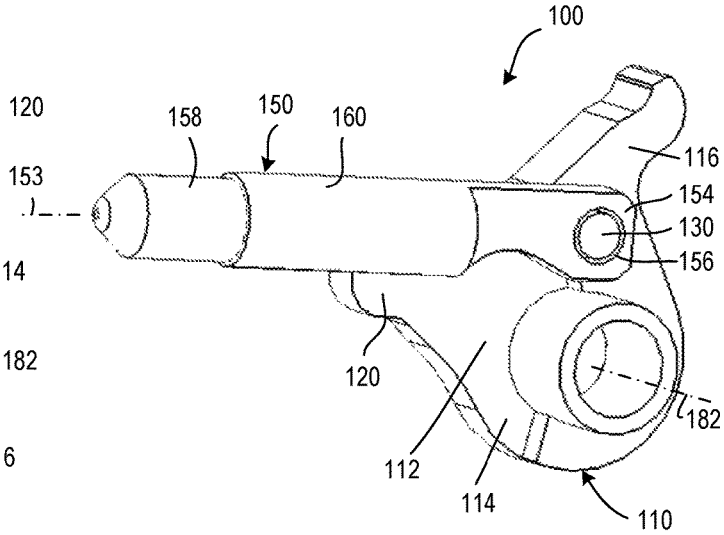
FIG. 8 illustrates a rear and right-side perspective view of the forward assist assembly of FIG. 6.
Figure 9:
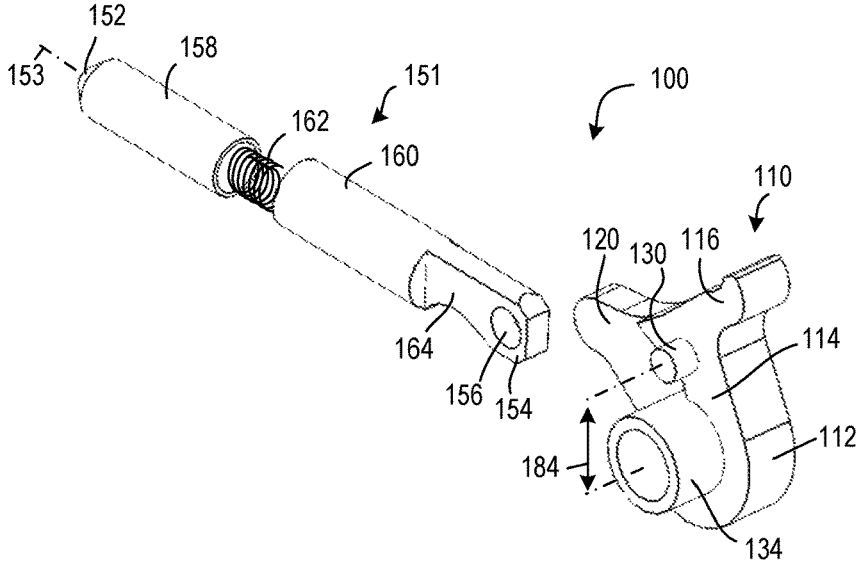
FIG. 9 illustrates an exploded top, front, and right-side perspective view of a forward assist assembly showing a spring piston and lever, in accordance with an embodiment the present disclosure.
Figure 10:
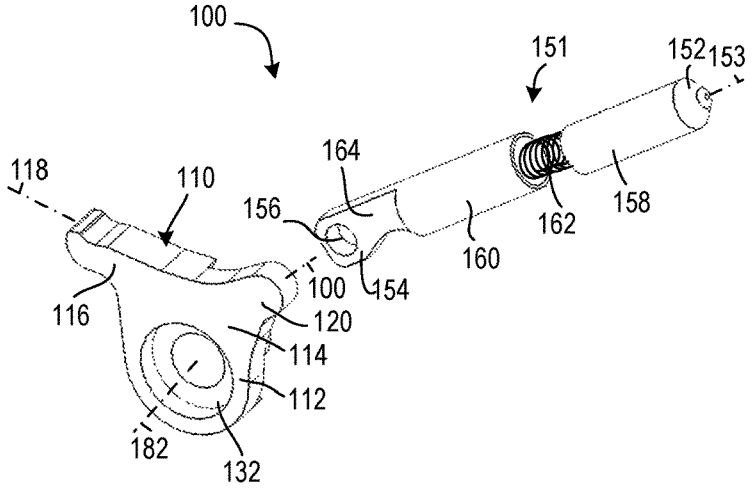
FIG. 10 illustrates an exploded top, rear, and left-side perspective view of the forward assist assembly of FIG. 9.

Referring now to FIGS. 6-10, forward assist assembly 100 including a lever 110 and an actuator 150 is illustrated in accordance with an embodiment of the present disclosure. FIG. 6 illustrates a left-side elevational view; FIG. 7 illustrates a top, front, and left-side perspective view; FIG. 8 illustrates a right-side and rear perspective view; FIG. 9 illustrates a top, front, and right-side perspective view showing the assembly exploded; and FIG. 10 illustrates a top, rear, and left-side perspective view showing the assembly exploded. FIGS. 6-8 show forward assist assembly 100 as it is oriented when slide 10 is in the battery position, such as illustrated in FIGS. 1-3.

In one embodiment, forward assist assembly 100 includes lever 110 and actuator 150 connected thereto. In some embodiments, actuator 150 can be, for example, a linear actuator such as a coil spring, a helical spring, an elastomer, or a spring piston extending between lever 110 and frame 30. Actuator can alternately extend between lever 110 and grip module 250, such as the body portion 251 of grip module 250 (shown in FIG. 16). In other embodiments, actuator 150 is a torsional actuator, such as a torsion spring disposed about pin 180 with arms connected to lever 110 and frame 30 or grip module 250. When actuator 150 is a spring, the spring can be in compression or at tension to provide a spring force to lever 110. Actuator 150 can also be a gas piston or other type of linear actuator that provides a force to lever 110 along an actuator axis 153.

In one embodiment, actuator 150 is a piston 151 connected to lever 110 at a location spaced radially from an axis of rotation 182 to define a lever arm 184. For example, lever 110 has a lever body 112 rotatable about a pin 180 that extends perpendicular to chassis 32 of frame 30. Lever body 110 can be attached to pin 180 and extends radially outward therefrom to an outer portion 114. In some embodiments, lever body 110 can have the shape of a circle or disc, a rectangle, a rectangle with rounded end, a dome, an oval, a racetrack shape, a pentagon, or some other shape as viewed along axis of rotation 182. Outer portion 114 can be symmetrical about pin 180, but often is not symmetrical and can extend away from pin 180 to a greater extent on one side of pin 180. In some embodiments, pin 180 is a safety lever pin extending into frame 30. In other embodiments, pin 180 can be another pin or a protrusion on frame 30.

A first working arm 116 extends along a first axis 118 from outer portion 114. A second working arm 120 extends along a second axis 122 from outer portion 114 in a direction generally away from first working arm 116. In some embodiments, first axis 118 and second axis 122 intersect within outer portion 114 and define an angle α therebetween from 120°-180°. For example, each of first arm 116 and second arm 120 extend transversely away from lever body 110 and in diverging directions close to being opposite directions. First working arm 116 is configured to engage slide 10 when slide 10 is within a predefined distance from the battery position. For example, actuator 150 applies a force to rotate lever 110 so that first working arm 116 engages catch surface 28 on slide 10 and pushes slide 10 towards the battery position. Second working arm 120 is configured to engage slide 10 to rotate lever 110 to various positions when slide 10 moves proximally or distally along frame 30, including disassembly/assembly of slide 10 and frame 30. For example, during recoil, slide 10 engages second working arm 120 and rotates first working arm 116 backward where it is positioned to enter recess 27 in slide 10 as slide 10 returns forward from the recoil position.

Actuator 150 extends from a first actuator end 152 to a second actuator end 154. First actuator end 152 is configured to engage proximal frame end portion 40 or the handgun grip module 250 adjacent thereto. In one embodiment, first actuator end 152 engages lug 50 on proximal frame end portion 40. For example, first actuator end 152 is configured to engage recess 51 defined in distal lug portion 50 of lug 48. In another example, first actuator end 152 defines a recess, opening, fork, notch, or other feature that receives lug 50 or a protrusion from lug 50. Numerous variations will be apparent in light of the present disclosure. Second actuator end 154 is pivotably attached to outer portion 114 of lever body 112. For example, second actuator end 154 defines an opening 156 that receives a protrusion 130 extending from outer portion 114 generally parallel to pin 180. Other suitable attachments are acceptable, such as a fastener, catch, or other attachment method. In some embodiments, actuator 150 can be a spring piston that includes a coil spring or the like, where the spring is compressed in actuator 150 to provide a spring force.

FIGS. 9 and 10 illustrate exploded, perspective views of forward assist assembly 100 shown in FIGS. 6-8. One embodiment of actuator 150 is a piston 151 that includes a plunger 158 telescopically received in a piston tube 160. Piston tube 160 also contains a spring 162, a quantity of gas, or other compressible and resilient structure that provides a resilient force along actuator axis 153. For example, spring 162 is compressed between piston plunger 158 and piston tube 160 to provide a spring force. In some embodiments, a piston head 164 of piston tube 160 has a reduced size compared to piston tube 160 to provide clearance for rotation of lever 110. Piston head 164 defines opening 156 configured to rotatably receive protrusion 130 on lever 110.

As illustrated, lever 110 includes a pin recess 132 defined in one face of lever body 112 and a pin collar 134 extending from an opposite face of lever body 112, both of which are coaxial with axis of rotation 182. Pin recess 132 and/or pin collar 134 facilitate attachment to pin 180 and rotation about pin 180. In other embodiments, lever body 112 can define a simple through opening configured to receive pin 180. Numerous other suitable configurations will be apparent in light of the present disclosure.

Figure 11:
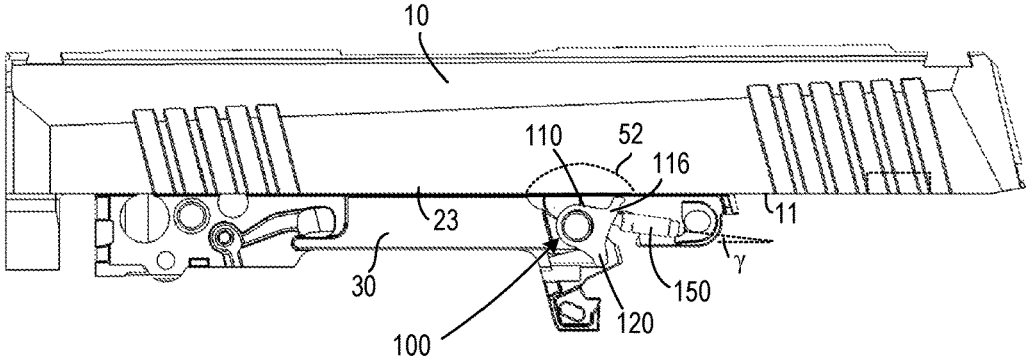
FIG. 11 illustrates a left-side elevational view of a forward assist assembly in use with a slide and receiver, where the slide is in the full recoil or slidelock position, in accordance with an embodiment the present disclosure.

Referring now to FIGS. 11-14, left-side elevational views illustrate forward assist assembly 100 in use with slide 10 and frame 30, where slide 10 is in various positions. FIG. 11 shows slide 10 fully displaced proximally along frame 30 in the slidelock for full recoil position. The slidelock or full recoil position is typically attained in response to firing the handgun 5 or after manually racking slide 10 rearward, where slide 10 may or may not be locked open in the recoil position. As slide 10 moves proximally (rearward) from the battery position to the slidelock or full recoil position shown in FIG. 11, slide 10 engages second working arm 120 and pivots first working arm 116 rearward through clearance recess 52 against the force of actuator 150 so that first working arm 116 extends upward and slightly rearward to engage a bottom surface 11 of slide rail 23. First working arm 116 maintains contact with slide rail 23 due to the force applied by spring 150 and lever 110. First working arm 116 is prevented from rotating forward (counterclockwise in FIG. 11) due to interference with slide rail 23. Second working arm 120 extends downward or downward and slightly rearward. In the slidelock or full recoil position, for example, actuator 150 is compressed and applies a force distally along actuator axis 153; however, the interference between slide 10 and first working arm 116 results in little or no upward force on slide 10 since angle γ between actuator axis 153 and slide rail 23 is small or zero (e.g., less than 10°).

Figure 12:
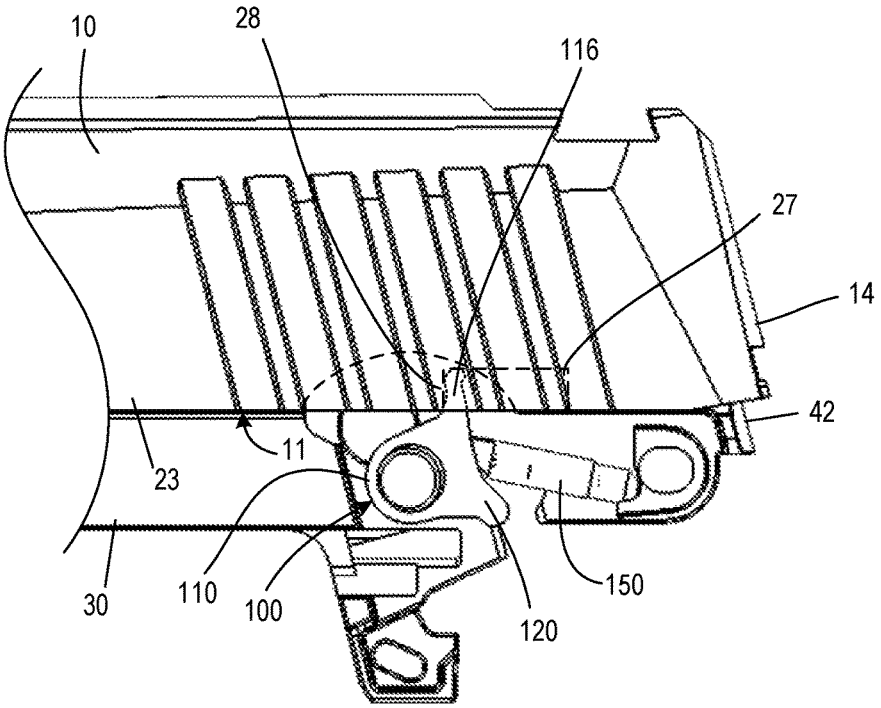
FIG. 12 illustrates a close-up left-side elevational view of the forward assist assembly of FIG. 11 showing the slide in a pre-battery position, in accordance with an embodiment the present disclosure.

FIG. 12 shows slide 10 displaced slightly proximally along frame 30 in a slight recoil position or pre-battery position. The position of FIG. 12 can be attained at the initial stages of recoil as slide 10 begins to move rearward and pivots first working arm 116 rearward. The position of FIG. 12 can also be attained as slide 10 is moving forward toward and approaches the battery position, i.e., a pre-battery position. The pre-battery position of FIG. 12 is consistent with the position of slide 10 in the out-of-battery malfunction, where proximal slide end 14 is misaligned with proximal frame end 42. Here, slide 10 is positioned sufficiently close to the battery position so that recess 27 is aligned with lever 110 and first working arm 116 can enter recess 27 to contact catch surface 28. Compared to the slidelock or full recoil position of FIG. 11, first working arm 116 of lever 110 is rotated forward (counterclockwise as shown in FIG. 12) so that first working arm 116 extends upward into recess 27 in contact with catch surface 28.

In the pre-battery position, actuator 150 exerts a force distally on lever 110, which applies forward torque via first working arm 116 to bias slide 10 towards the battery position. As such, the force from actuator 150 augments the force of the recoil return spring 204 (shown in FIG. 16) and continues to do so as slide 10 moves fully to the battery position. In some embodiments, first working arm 116 aligns with recess 27 to contact catch surface 28 and apply a force distally to slide 10 when slide 10 is within a predefined distance of 1, 2, 3, 4, 5, 6, 7, 8, or 10 mm or less from the battery position during distal movement of slide 10. In some embodiments, for example, slide 10 is five mm or less from the battery position in order for lever to act on catch surface 28. In other embodiments slide 10 is four mm or less, three mm or less, or two mm or less from the battery position in order for lever 110 to act on catch surface 28 of slide 10. In some embodiments, the force of actuator 150 is from 1 to 5 lbs., such as 1-3 lbs., 2-4 lbs., 2-3 lbs., or 3-5 lbs. In some embodiments, the force is at least 1 lb. or at least 2 lbs. when slide 10 is in the battery position. The force of actuator 150 can be defined, for example, as a peak force along actuator axis 153, a peak force in a direction parallel to the bore axis, an average force of actuator 150 along its working length, or a force of actuator 150 applied in a direction parallel to the bore axis when slide 10 is less than a predefined distance from the battery position, such as with 2 mm of battery. In some embodiments, the force of actuator 150 changes linearly or non-linearly with the working length of actuator 150. In other embodiments, actuator 150 provides a substantially constant force along its working length, such as varying less than 10%. Numerous configurations and variations will be apparent in light of this disclosure.

From the slight recoil position of FIG. 12, if slide 10 moves further rearward in recoil, first working arm 116 will rotate rearward. In doing so, first working arm 116 will engage and then slide along bottom surface 11 of slide rail 23 during slide 10 movement to the full recoil position shown, for example, in FIG. 11. First working arm 116 will maintain such a position in contact with bottom surface 11 due to interference between slide rail 23 and due to forward bias of spring 150.

Figure 13:
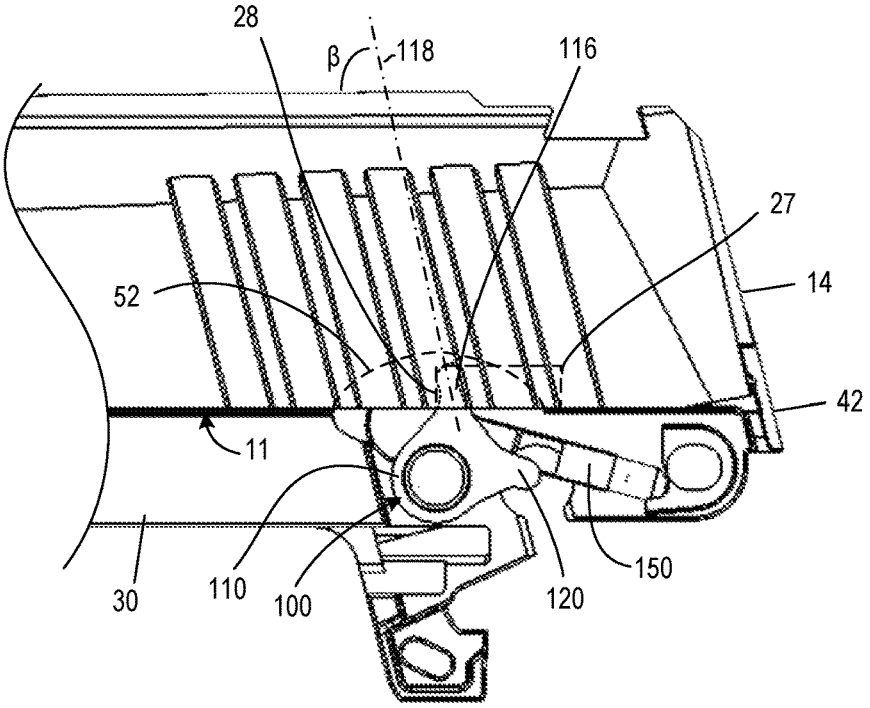
FIG. 13 illustrates a close-up left-side elevational view of the forward assist assembly of FIG. 11 showing the slide in a battery position, in accordance with an embodiment the present disclosure.

FIG. 13 shows slide 10 in the battery position. In some embodiments, the battery position is indicated by proximal slide end 14 being flush or aligned with proximal frame end 42, for example. In other embodiments, the aligned condition is not met, but some other recognizable relationship between proximal slide end 14 and proximal frame end 42 or other alignment of parts can be used to indicate slide 10 being in the battery position. For example, indicia on slide 10, frame 30, and frame (not shown) could be used to determine the battery position, including serrations, chamber opening, indentations, pin openings, distal end portions, alignment marks, or other indicia. In the battery position, first working arm 116 contacts catch surface 28 of recess 27 and is biased forward by actuator 150, where the force of actuator 150 augments the force of the recoil return spring 204 (shown in FIG. 16). In the battery position in some embodiments, first working arm 116 extends upward or upward and forward at an angle β with respect to bottom surface 11 of slide rail 23, where angle β has a value from 30° to 90°, including 30° to 40°, 40° to 50°, 50° to 60°, 60° to 70°, 70° to 80°, 80° to 90°, 30° to 60°, 45° to 70°, 60° to 80°, 60° to 90°, or other angle or range of angles.

Figure 14:
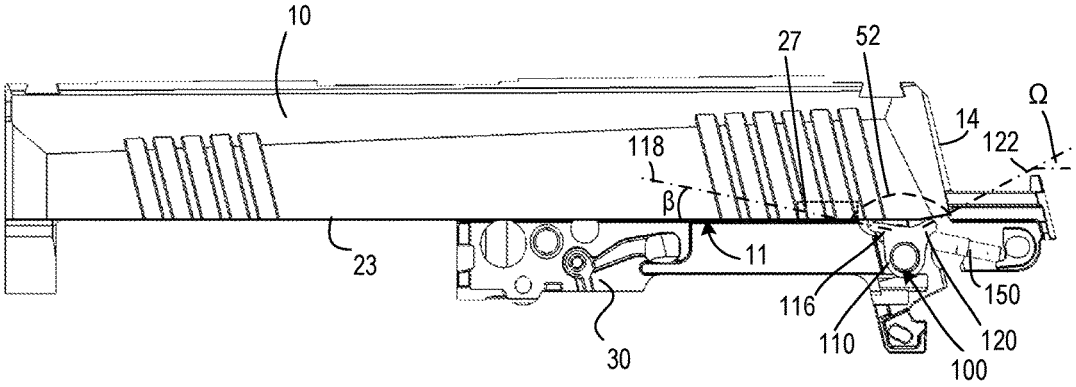
FIG. 14 illustrates a left-side elevational view of the forward assist assembly, slide, and frame of FIG. 11 showing the slide in a takedown or reassembly position, in accordance with an embodiment of the present disclosure.

FIG. 14 shows slide 10 in a takedown or reassembly position in which slide 10 has been displaced distally along frame 30 from the battery position. The position of FIG. 14 can be attained during takedown as slide 10 is being removed distally from frame 30. The position of FIG. 14 can also be attained as slide 10 is being assembled onto frame 30 in a proximal direction. Here, lever 110 has been rotated forward as the result of recess 27 moving proximally while engaging first working arm 116. Lever 110 is now positioned with first working arm 116 either in contact with or close to bottom surface 11 of slide rail 23. First working arm 116 extends generally forward in a horizontal position along bottom surface 11 of slide 10 or forward and upward with an angle θ from 0° to 45° or any value therebetween as defined between first axis 118 and bottom surface 11 of slide 10. Second working arm 120 extends generally rearward also in contact with or close to bottom surface 11 of slide rail 23. Second working arm 120 defines an angle Ω as defined between second axis 122 and bottom surface 11, where angle Ω is from 0° to 45° or any value therebetween. In some embodiments, angle β and/or angle Ω is from 0° to 15°, 10° to 20°, or 10° to 30°, for example. So long as slide 10 is positioned distally of the battery position, first working arm 116 and second working arm 120 will maintain this position in contact with or close to bottom surface 11 of slide 10.

Figure 15:
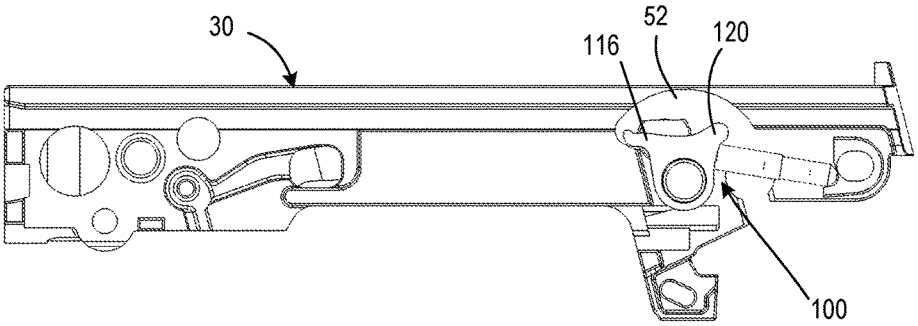
FIG. 15 illustrates a left-side elevational view of the frame and forward assist assembly of FIG. 11 with the slide removed, in accordance with an embodiment of the present disclosure.

FIG. 15 illustrates a side elevational view of frame 30 and forward assist assembly 100 with slide 10 removed completely. With slide 10 removed, first working arm 116 extends forward where it can rotate no further due to engagement with chassis 32 along clearance recess 52, for example. Second working arm 120 extends upward due to the force provided by actuator 150 to rotate lever 110 forward. Accordingly, when slide 10 is reassembled onto frame 30, proximal slide end 14 will engage second working arm 120, which extends upward into the path of slide 10, and slide 10 will rotate lever 110 to the position shown in FIG. 14 with first working arm 116 and second working arm 120 engaging bottom surface 11 of slide rail 23. As slide 10 continues to move proximally into the battery position (FIG. 13), first working arm 116 will enter recess 27. Moving slide 10 further proximally to the recoil position will rotate lever 110 so that first working arm 116 contacts bottom surface 11 of slide rail 23, such as shown in FIG. 11.

Although forward assist assembly 100 is shown and discussed as located on the left side of frame 30, the present disclosure contemplates forward assist assembly 100 on the right side of frame 30 or on both the left and right sides of frame 30. Also, while forward assist assembly 100 is shown and discussed as being located along proximal frame end portion 40, forward assist assembly 100 can be positioned at any suitable location along frame 30.

Figure 16:
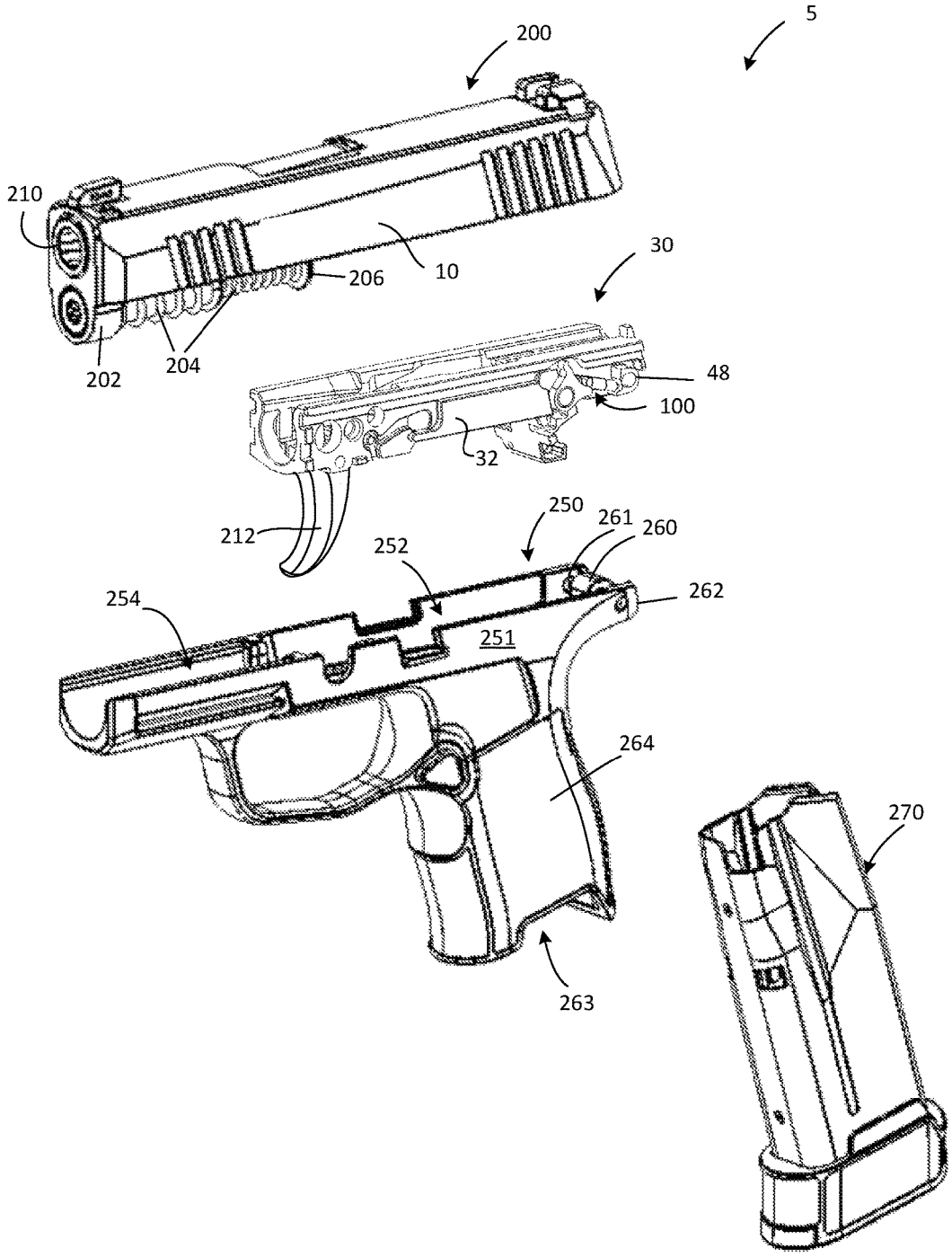
FIG. 16 illustrates an exploded top, front, and left-side perspective view showing a component groups of a handgun, including a forward assist assembly, in accordance with an embodiment the present disclosure.

FIG. 16 illustrates a front, top, and left-side perspective exploded view showing components groups of a handgun 5 and including an embodiment of a forward assist assembly 100, in accordance with the present disclosure. Handgun 5 includes slide assembly 200 with slide 10, slide recoil guide 202, recoil return spring(s) 204, recoil spring rod 206, and barrel 210. Frame 30 is shown with trigger 31 and forward assist assembly 100; other components of the fire control group are omitted for convenience. Grip module 250 has a body portion 251 and a handgrip portion 264 extending transversely therefrom. Body portion 251 of grip module 250 has an upwardly open channel that defines frame well 252 and recoil spring well 254. Frame 30 can be disposed in frame well 252 with lugs 48 received in lug recesses 261 adjacent grip lug 260 and with proximal frame end 42 aligned with and/or flush with proximal end 262 of grip module 250. A magazine 270 can be received in a magazine well 263 defined in handgrip portion 264 of grip module 250.

Figure 17:
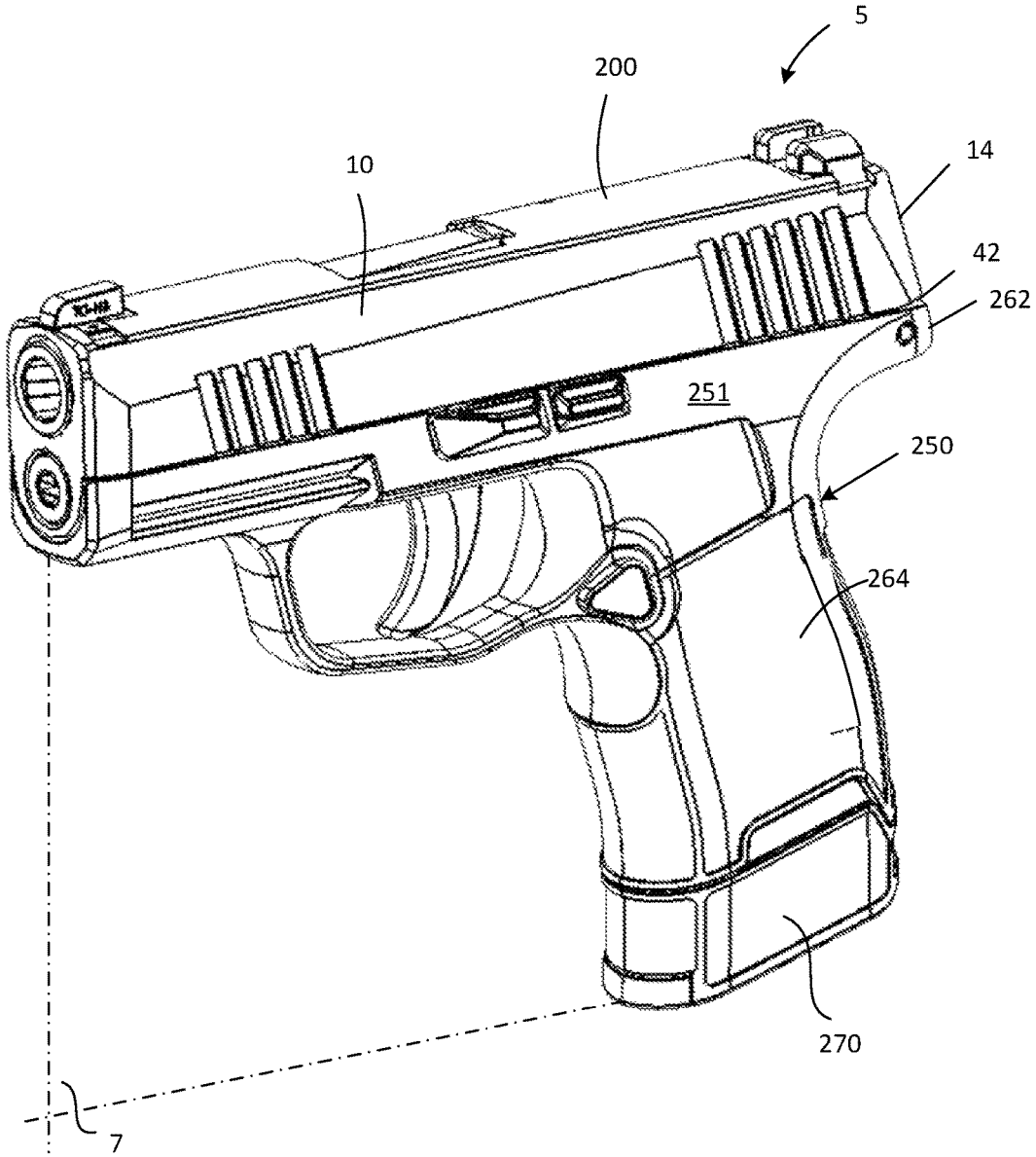
FIG. 17 illustrates a top, front, and left-side perspective view of the handgun of FIG. 16 in an assembled form, in accordance with an embodiment the present disclosure.

FIG. 17 illustrates a top, front, and left-side perspective view of handgun 5 in assembled form and including the component groups shown in FIG. 16. A median plane 7 extends through handgun 5. As illustrated, slide 10 is in the battery position with proximal slide end 14 aligned with frame proximal end 42 and frame proximal end 262.

In use, forward assist assembly 100 in accordance with embodiments of the present disclosure advantageously prevents or reduces the occurrence of the out-of-battery malfunction by augmenting the forward force of the recoil return spring(s) 204 as slide 10 approaches the battery position. As discussed above, forward assist assembly 100 provides a forward force on slide 10 when slide 10 is in the battery position and when slide 10 is in the recoil position within a predetermined distance of the battery position, such as a pre-battery position. In embodiments, where lever 110 engages catch surface 28 only when slide 10 is within the predetermined distance from the battery position, forward assist assembly 100 increases the force needed to rack slide 10 only when slide 10 is within that predetermined distance. In other words, forward assist assembly 100 augments the force of recoil return spring 204 only during the initial movement out of battery in a proximal direction, such as within 2, 3, 4 or 5 mm of battery. Therefore, handguns requiring less force to rack slide 10 remain largely unchanged in this respect. For example, recoil return spring 204 can have a force of 8-10 lbs. instead of 10-12 lbs. Slide 10 can be moved to the recoil position, to the battery position, removed from frame 30, and reassembled onto frame 30 with lever 110 engaging slide 10 and being positioned as needed so that first working arm 116 engages catch surface 28 when slide 10 is approaching the battery position from a recoil position.

Forward assist assembly 100 may be constructed from any suitable material(s), as will be apparent in light of this disclosure. For example, some embodiments of forward assist assembly 100 can be constructed from steel, aluminum, titanium, reinforced polymer composites, or other materials. More generally, components of the present disclosure can be constructed from any suitable material, including, for example, materials and finishes compliant with United States Defense Standard MIL-W-13855D (Weapons: Small Arms and Aircraft Armament Subsystems, General Specification For).

Further Example Embodiments

The following examples pertain to further embodiments, from which numerous permutations and configurations will be apparent.

Example 1 is a handgun comprising a frame with a distal frame portion and a proximal frame portion, the frame configured to house a fire control group and having frame rails extending longitudinally along a top of the frame; a slide displaceable along the frame rails between a recoil position and a battery position, the slide defining a catch surface; and a forward assist assembly constructed and arranged to exert a force in a distal direction on the slide when the slide is within a predetermined distance from the battery position.

Example 2 includes the subject matter of Example 1 and further comprises a grip module defining a frame well, wherein the frame is secured in the frame well and the forward assist assembly is disposed between the slide and an inside of the grip module.

Example 3 includes the subject matter of Example 1, wherein the forward assist assembly is disposed between the slide and the frame.

Example 4 includes the subject matter of Example 3 and further comprises a grip module defining a frame well, wherein the frame is secured in the frame well with the frame rails positioned along a top portion of the grip module; and a lug on the proximal frame end portion, the lug configured to engage an inside of the grip module when the frame is installed in the frame well; wherein the forward assist assembly is disposed between the lug and the slide.

Example 5 includes the subject matter of Example 4, wherein the forward assist assembly comprises a lever attached to the frame and rotatable about a pin extending laterally to the frame, the lever having a lever body attached to the pin and extending radially outward from the pin to an outer portion, a first working arm extending transversely along a first axis from the outer portion, and a second working arm extending transversely along a second axis from the outer portion, wherein the first axis and the second axis define an angle therebetween from 120°-180°; and an actuator connected between the lever and the frame, the actuator biasing the lever to rotate about the pin and cause the first working arm to engage the catch surface and exert the force on the catch surface when the slide is within the predetermined distance from the battery position.

Example 6 includes the subject matter of Example 5, wherein the actuator comprises a spring selected from a coil spring, a helical spring, and a torsion spring.

Example 7 includes the subject matter of any of Examples 5 or 6, wherein when the slide approaches the battery position from the recoil position, the first working arm engages the catch surface and exerts the force on the slide to urge the slide to the battery position; and when the slide is in the recoil position, the first working arm extends upward in contact with a bottom surface of the slide.

Example 8 includes the subject matter of Example 7, wherein as the slide moves forward off the frame from the battery position, the first working arm extends forward in contact with the bottom surface of the slide and the second arm extends rearward in contact with the bottom surface of the slide; and as the slide moves rearward onto the frame after being removed from the frame, the proximal end portion of the slide engages the second arm and rotates the lever so that the first arm engages the catch surface when the slide is in the battery position;

Example 9 includes the subject matter of Examples 7 or 8, wherein the catch surface is defined by a recess in a sidewall that extends along the slide and includes the bottom surface of the slide.

Example 10 includes the subject matter of any of Examples 5 and 7-9, wherein the actuator is a spring piston extending along an actuator axis from a first piston end to a second piston end, the first piston end engaging the frame and the second piston end pivotably attached to the outer portion of the lever body, the actuator exerting a force along the actuator axis.

Example 11 includes the subject matter of Example 10, wherein the first piston end engages the lug on the proximal frame end portion.

Example 12 includes the subject matter of Example 10 or 11, wherein the second piston end is attached to the outer portion of the lever body adjacent the intersection between the first axis and the second axis.

Example 13 includes the subject matter of Example 10 or 11, wherein the second piston end is located between the pin and the slide when the slide is in the battery position.

Example 14 includes the subject matter of any of Examples 10-13, wherein the force of the actuator is from 1 to 5 lbs. For example, the force of the actuator is 1-3 lbs., 2-4 lbs., or 2-3 lbs.

Example 15 includes the subject matter of Example 14, wherein the force is at least 2 lbs. when the slide is in the battery position.

Example 16 includes the subject matter of any of Examples 1-15, wherein the predetermined distance is ten millimeters or less.

Example 17 includes the subject matter of Example 16, wherein the predetermined distance is five millimeters or less.

Example 18 includes the subject matter of any of Examples 1-17 and further comprises a recoil spring assembly disposed between the distal slide end portion and the frame, the recoil spring assembly configured to bias the slide towards the battery position, wherein the forward assist assembly augments a force of the recoil spring assembly when the slide is within the predetermined distance from the battery position.

Example 19 is a handgun subassembly comprising a frame with a distal frame portion and a proximal frame end portion, the frame having frame rails extending longitudinally along a top of the frame; a slide displaceable along the frame rails between a recoil position and a battery position, the slide defining a slide channel corresponding to each of the frame rails and extending along the slide, the slide defining a catch surface adjacent a bottom portion of the slide; and a forward assist assembly disposed between the slide and the proximal frame end portion, the forward assist assembly providing a force on the slide in a distal direction when the slide is within a predetermined distance from the battery position.

Example 20 includes the subject matter of Example 19, wherein the forward assist assembly comprises a lever rotatable about a pin extending perpendicularly to the frame, the lever having a lever body extending radially away from the pin to an outer portion, a first working arm extending transversely along a first axis from the outer portion, and a second working arm extending transversely along a second axis from the outer portion, wherein the first axis and the second axis define an angle therebetween from 120°-180°; and a piston extending from a first piston end to a second piston end, the first piston end engaging the frame and the second piston end connected to the lever body; wherein at least one of the first working arm and the second arm contacts the slide when the slide is attached to the frame.

Example 21 includes the subject matter of Example 20 further comprising a lug on an outside of the proximal frame end portion, the first piston end engaging the lug.

Example 22 includes the subject matter of any of Examples 19-21, wherein the slide defines a notch extending upward through a slide rail to one of the slide channels above the slide rail, the notch defining the catch surface.

Example 23 includes the subject matter of Example 19, wherein the forward assist assembly comprises a lever rotatable about a pin extending perpendicularly to the frame, the lever including a lever body extending radially away from the pin to an outer portion, a first working arm extending transversely along a first axis from the outer portion, and a second working arm extending transversely along a second axis from the outer portion, wherein the first axis and the second axis define an angle therebetween from 120°-180°; and a torsion spring installed on the pin and having a first spring leg engaging the lever and a second spring leg engaging the frame; wherein the torsion spring biases the lever to rotate about the pin with the first working arm exerting the force on the catch surface when the slide is within the predetermined distance.

Any of the above example embodiments can comprise or be a portion of a semiautomatic handgun utilizing a blowback, locked breech, or hesitation lock operation. For example, the handgun is a striker-fired handgun with a polymer grip module and frame disposed removably in the grip module. In another example, the handgun has a double action/single action operation, a single-action-only operation, or a double-action-only operation. The handgun can be chambered for any suitable handgun ammunition, including but not limited to .22 LR, .380 Auto, 9 mm Luger, 10 mm, .40 S&W, .357 SIG, .45 ACP or the like.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A handgun comprising:

a frame with a distal frame portion and a proximal frame portion, the frame configured to house a fire control group and having frame rails extending longitudinally along a top of the frame;

a slide displaceable along the frame rails between a recoil position and a battery position, the slide defining a catch surface; and a forward assist assembly constructed and arranged to exert a force in a distal direction on the slide only when the slide is within a predetermined distance from the battery position.

2. The handgun of claim 1 further comprising a grip module defining a frame well, wherein the frame is secured in the frame well and the forward assist assembly is disposed between the slide and an inside of the grip module.

3. The handgun of claim 1, wherein the forward assist assembly is disposed between the slide and the frame.

4. The handgun of claim 3, further comprising:

a grip module defining a frame well, wherein the frame is secured in the frame well with the frame rails positioned along a top portion of the grip module; and a lug on the proximal frame end portion, the lug configured to engage an inside of the grip module when the frame is installed in the frame well;

wherein the forward assist assembly is disposed between the lug and the slide.

5. The handgun of claim 1, wherein the forward assist assembly comprises:

a lever attached to the frame and rotatable about a pin extending laterally to the frame, the lever having a lever body attached to the pin and extending radially outward from the pin to an outer portion, a first working arm extending transversely along a first axis from the outer portion, and a second working arm extending transversely along a second axis from the outer portion, wherein the first axis and the second axis define an angle therebetween from 120°-180°; and an actuator connected between the lever and the frame, the actuator biasing the lever to rotate about the pin and cause the first working arm to engage the catch surface and exert the force on the catch surface when the slide is within the predetermined distance from the battery position.

6. The handgun of claim 5, wherein the actuator comprises a spring selected from a coil spring, a helical spring, and a torsion spring.

7. The handgun of claim 5, wherein:

when the slide approaches the battery position from the recoil position, the first working arm engages the catch surface and exerts the force on the slide to urge the slide to the battery position; and when the slide is in the recoil position, the first working arm extends upward in contact with a bottom surface of the slide.

8. The handgun of claim 7, wherein as the slide moves forward off the frame from the battery position, the first working arm extends forward in contact with the bottom surface of the slide and the second arm extends rearward in contact with the bottom surface of the slide; and as the slide moves rearward onto the frame after being removed from the frame, the proximal end portion of the slide engages the second arm and rotates the lever so that the first arm engages the catch surface when the slide is in the battery position.

9. The handgun of claim 7, wherein the catch surface is defined by a recess in a sidewall that extends along the slide and includes the bottom surface of the slide.

10. The handgun of claim 5, wherein the actuator is a spring piston extending along an actuator axis from a first piston end to a second piston end, the first piston end engaging the frame and the second piston end pivotably attached to the outer portion of the lever body, the actuator exerting a force along the actuator axis.

11. The handgun of claim 10, wherein the first piston end engages the lug on the proximal frame end portion.

12. The handgun of claim 11, wherein the second piston end is attached to the outer portion of the lever body adjacent the intersection between the first axis and the second axis.

13. The handgun of claim 10, wherein the second piston end is located between the pin and the slide when the slide is in the battery position.

14. The handgun of claim 10, wherein the force of the actuator is from 1 to 5 lbs.

15. The handgun of claim 14, wherein the force is at least 2 lbs. when the slide is in the battery position.

16. The handgun of claim 1, wherein the predetermined distance is ten millimeters or less.

17. The handgun of claim 1, wherein the predetermined distance is five millimeters or less.

18. The handgun of claim 1 further comprising:

a recoil spring assembly between the slide and the frame, the recoil spring assembly configured to exert a distal force on the slide when the slide is displaced rearward from the battery position, wherein the forward assist assembly augments the distal force of the recoil spring assembly when the slide is within the predetermined distance from the battery position.

19. A handgun subassembly comprising:

a frame with a distal frame portion and a proximal frame end portion, the frame having frame rails extending longitudinally along a top of the frame;

a slide displaceable along the frame rails between a recoil position and a battery position, the slide defining a slide channel corresponding to each of the frame rails and extending along the slide, the slide defining a catch surface adjacent a bottom portion of the slide;

a recoil spring assembly exerting a force on the slide in a distal direction; and a forward assist assembly between the slide and the frame, the forward assist assembly providing an additional force on the slide in a distal direction only when the slide is within a predetermined distance from the battery position.

20. The handgun subassembly of claim 19, wherein the forward assist assembly comprises:

a lever rotatable about a pin extending perpendicularly to the frame, the lever having a lever body extending radially away from the pin to an outer portion, a first working arm extending transversely along a first axis from the outer portion, and a second working arm extending transversely along a second axis from the outer portion, wherein the first axis and the second axis define an angle therebetween from 120°-180°; and a piston extending from a first piston end to a second piston end, the first piston end engaging the frame and the second piston end connected to the lever body;

wherein at least one of the first working arm and the second arm contacts the slide when the slide is attached to the frame.

21. The handgun subassembly of claim 20 further comprising a lug on an outside of the proximal frame end portion, the first piston end engaging the lug.

22. The handgun subassembly of claim 19, wherein the slide defines a notch extending upward through a slide rail to one of the slide channels above the slide rail, wherein the notch defines the catch surface.

23. The handgun subassembly of claim 19, wherein the forward assist assembly comprises:

a lever rotatable about a pin extending perpendicularly to the frame, the lever including a lever body extending radially away from the pin to an outer portion, a first working arm extending transversely along a first axis from the outer portion, and a second working arm extending transversely along a second axis from the outer portion, wherein the first axis and the second axis define an angle therebetween from 120°-180°; and a torsion spring installed on the pin and having a first spring leg engaging the lever and a second spring leg engaging the frame; wherein the torsion spring biases the lever to rotate about the pin with the first working arm exerting the force on the catch surface when the slide is within the predetermined distance.

* * * * *